US009119765B2

(12) United States Patent
Topolev

(10) Patent No.: US 9,119,765 B2
(45) Date of Patent: Sep. 1, 2015

(54) STIMULATOR WITH FLEXIBLE ELEMENTS (VARIANT EMBODIMENTS)

(76) Inventor: Sergei E. Topolev, Sestroretsk (RU)

( * ) Notice: Subject to any disclaimer, the term of this patent is extended or adjusted under 35 U.S.C. 154(b) by 486 days.

(21) Appl. No.: 13/512,481

(22) PCT Filed: Nov. 25, 2010

(86) PCT No.: PCT/RU2010/000726

§ 371 (c)(1),
(2), (4) Date: May 29, 2012

(87) PCT Pub. No.: WO2011/065870

PCT Pub. Date: Jun. 3, 2011

(65) Prior Publication Data

US 2012/0316390 A1 Dec. 13, 2012

(30) Foreign Application Priority Data

Nov. 26, 2009 (RU) ..... 2009145050

(51) Int. Cl.
*A61F 5/00* (2006.01)
*A61H 19/00* (2006.01)
*A61H 23/00* (2006.01)

(52) U.S. Cl.
CPC ..... *A61H 19/34* (2013.01); *A61H 19/30* (2013.01); *A61H 19/40* (2013.01); *A61H 19/44* (2013.01); *A61H 23/00* (2013.01); *A61H 2201/0103* (2013.01); *A61H 2201/0153* (2013.01); *A61H 2205/086* (2013.01)

(58) Field of Classification Search
CPC ..... A61H 19/30; A61H 19/32; A61H 19/34; A61H 19/40; A61H 19/44
USPC ..... 600/38–41; 601/46
See application file for complete search history.

(56) References Cited

U.S. PATENT DOCUMENTS 5,690,603 A 11/1997 Kain
5,853,362 A 12/1998 Jacobs
2008/0119767 A1* 5/2008 Berry et al. ..... 601/46

FOREIGN PATENT DOCUMENTS

RU 2020912 C1 10/1994
RU 97115257 7/1999

OTHER PUBLICATIONS

Interanational Search Report, PCT/RU2010/000726, dated Jun. 16, 2011.

* cited by examiner

*Primary Examiner* — John Lacyk
(74) *Attorney, Agent, or Firm* — Alexander Rabinovich

(57) ABSTRACT

A device for sexual stimulation, intended for enhancing arousal, facilitating orgasm and improving blood circulation in the genitals to correct sexual inadequacy, comprises two elongated members mutually connected with their first ends. At least one of the members is made of a resilient material such as silicon rubber so that its second end is bent off the second member and adapted to be resiliently brought toward the second member second end to form a dildo. The second end of the first member can be fixedly attached to the second member when brought toward it. At least one vibrating device can be placed in one of the members. The device provides for vaginal extension without extension of a vaginal opening, increases a zone of stimulation, is suitable for frictions in the vagina and makes it possible to achieve intense and continuous stimulation of internal genitals when performing frictional stimulation.

7 Claims, 2 Drawing Sheets

STIMULATOR WITH FLEXIBLE ELEMENTS (VARIANT EMBODIMENTS)

CROSS-REFERENCE TO RELATED APPLICATIONS

This application is a U.S. National phase application of the International application PCT/RU2010/000726 and claims priority to application 2009145050 filed on Nov. 26, 2009 in the Russian Federation, the both International and Russian applications being hereby incorporated by reference in their entirety.

BACKGROUND OF THE INVENTION

The invention relates to medical equipment, sexuality section, and in particular, to devices for personal use, aimed at intensifying arousal and facilitating the achievement of orgasm, and can be used to massage the genitalia and to correct sexual disharmony.

The analogue of the invention is a device for sexual stimulation, which has one base and two elongated members for simultaneous vaginal and anal stimulation (U.S. D 536,458). The disadvantage of this device is the inability or soreness in opening the vagina when inserting both members at the same time for stimulating the vagina. Also, their shape and physical properties do not allow to significantly increase the stimulating effect of the vagina by expand.

SUMMARY OF THE INVENTION

An essential feature of the invention is providing a phallic-like device with a longitudinal split i of the device into two elongated members, one or both of which are bent in the direction of the longitudinal axis and are made of resilient rubber-like material, able to flex relative to the longitudinal axis of the device.

An additional feature is the implementation of radius bending of at least one elongate member made of a resilient material which allows moving smoothly through the vaginal opening. An additional feature is the presence of a locking element which allows fixing two members when their second ends are brought toward each other, for which purpose the device comprises electromagnetic elements on the second ends.

The object of the invention is to strengthen the stimulating effect by means of increasing a stimulated area of the vagina by its expansion, without a considerable expansion of the vaginal opening, as well as increasing sexual arousal and enhanced stimulation of the inner vaginal erogenous zones, in particular the G-spot, and preventing sexual disorders. The technical result of the invention is the vaginal extension without the extension of the vaginal opening with frictional stimulation.

DETAILED DESCRIPTION OF THE PREFERRED EMBODIMENTS

Figure 1:
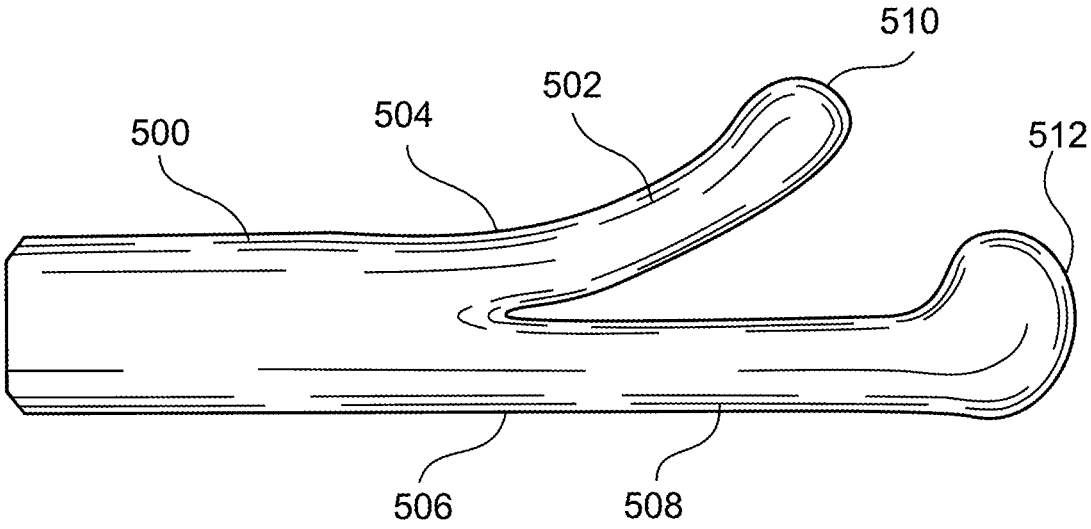
FIG. 1 shows a front view of the device with one curved elongated member in a static position.
Figure 2:
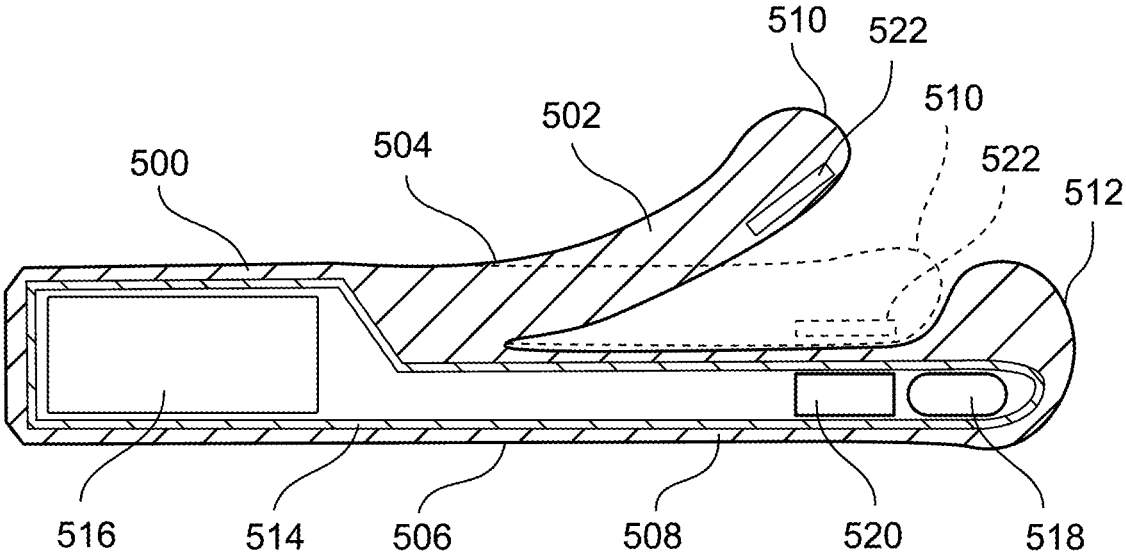
FIG. 2 shows a centrally longitudinal cross-section of FIG. 1, the dashed line showing closely spaced elongated members in a position for insertion.

Implementation of the invention according to FIGS. 1 and 2. A device 500 for sexual stimulation made of a resilient material comprises a first elongated member 502 which is connected at its first end 504 to the first end 506 of second elongate member 508 coated with the same material. The second end 510 of the first member 502 is bent off from a second end 512 of second member 508. The user brings second end 510 toward to second end 512 and inserts it into the vagina. When the device 500 moves deeper in the vagina, the second end 510 of the member 502 is bent off from the second end 512 of the second member 508. When the device does a reverse movement, the second end 510 of the member 502 and the second end 512 of the second member 508 come together. The user does not pulls out the device completely, so that when the movement inside the vagina is a again forward, the second end 510 is again unbent from the second end 512. Placed inside the second member is a rigid case 514 containing a power and control unit 516, a vibrating device 518, and an electromagnetic device 520 preferably shifted to the second end 512 of the second member 508. The control unit 516 supplies power to the vibration device 518 that vibrates and thereby enhances stimulation. Also, the control unit 516 energizes the electromagnetic device 520, as the second end 510 of the first member 502 comes closer to the second end 512 of the second member 508. Under the influence of the magnetic field, the magnetically active element 522 is attracted to the electromagnetic device, and fixes together ends 510 and 512. In this position, the user can use the device as a conventional dildo or vibrator. Powering off the second end 510 of the first member 502 results in bending it off from the second end 512 of second member 508. The device is made of silicone rubber, the rigid case is made of plastic covered with silicone rubber.

Figure 3:
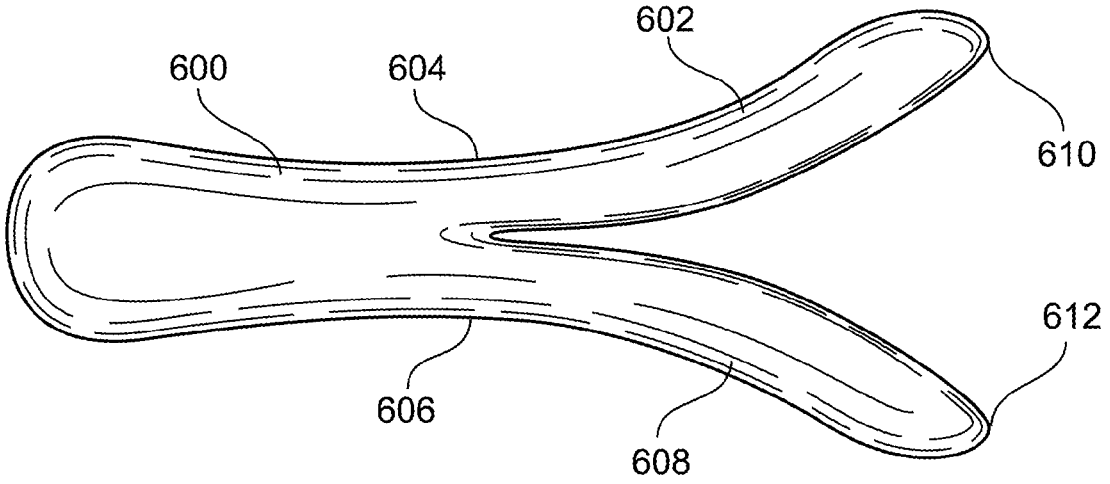
FIG. 3 shows a front view of the device with the two curved elongated members in a static position.
Figure 4:
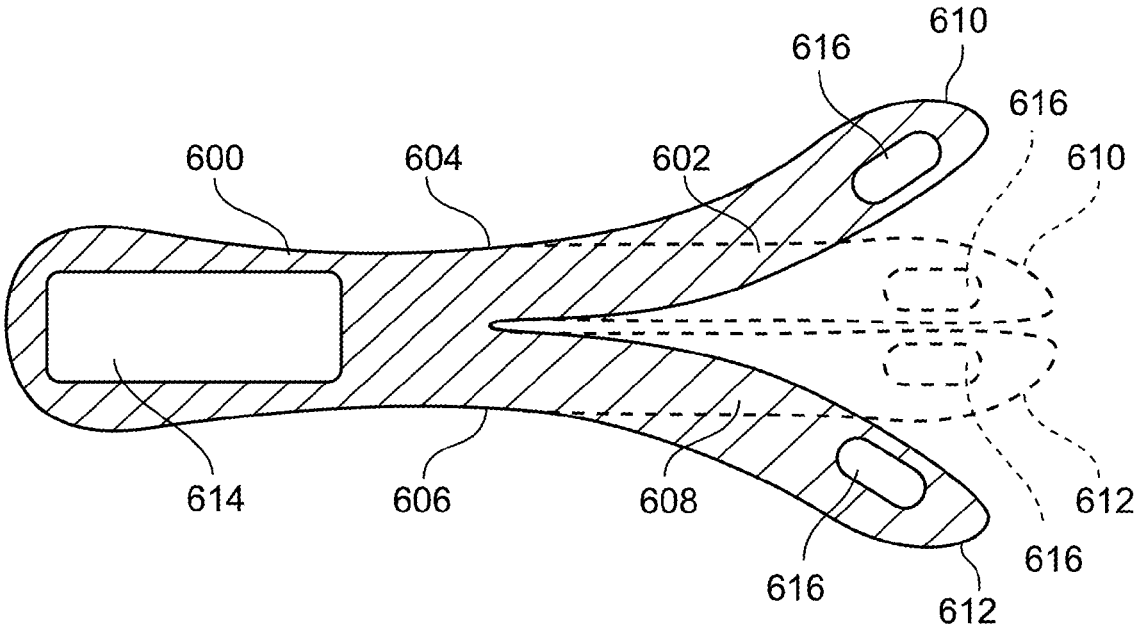
FIG. 4 shows a centrally longitudinal cross-section of FIG. 3, the dashed line showing closely spaced elongated members in an insertion position.

Implementation of the invention according to FIG. 3 and FIG. 4. A device 600 for sexual stimulation is made of a resilient material and comprises a first elongated member 602 connected at its first end 604 to a first end 606 of a second elongated member 608. The second ends 610 and 612 of the elongated elements 602 and 608 are bent away from each other. The device 600 comprises a power and control unit 614, vibrating elements 616 mounted in the second ends 610 and 612. The user brings the second ends 610 and 612 to each other and inserts them into the vagina. Inside the vagina, the second ends 610 and 612 unbend as they move deeper into the vagina. In the reverse movement, the second ends 612 and 610 are bent toward each other. The user does not pull the device out completely, so that when the direction of the movement inside the vagina changes again, the second ends 610 and 612 are unbent again. Using the control unit 614 the user powers the vibrating elements 616 that vibrate and thereby enhance stimulation. The device is made of silicone rubber, preferably of circular cross-section, and elongated members are preferably of a semicircular cross-section with flat sides facing each other. This device in essence is dildo, one end of which is split into two curved members, with their free ends bent away from each other.

The invention claimed is:

1. A device for sexual stimulation, comprising a first elongated member and a second elongated member connected to each other with their first ends, wherein at least the first elongated member is made of a resilient material so that a second end of the first elongated member is bent off the second elongated member in a continuous curvilinear manner away from the second elongated member and adapted to be resiliently brought toward a second end of the second elongated member to form essentially a dildo.

2. A device for sexual stimulation, comprising a first elongated member and a second elongated member connected to each other with their first ends, wherein at least the first elongated member is made of a resilient material so that a second end of the first elongated member is bent off the second elongated member and adapted to be resiliently brought toward a second end of the second elongated member to form essentially a dildo and wherein the second end of the first elongated member is adapted to be fixedly attached to the second elongated member when brought toward the second elongated member.

3. The device of claim 1, wherein at least the first elongated member is made of silicone rubber.

4. The device of claim 1, further comprising at least one vibrating device placed in one of the elongated members.

5. The device of claim 2, wherein said at least first elongated member is bent curvilineally.

6. The device of claim 2, wherein at least the first elongated member is made of silicone rubber.

7. The device of claim 2, further comprising at least one vibrating device placed in one of the elongated members.

* * * * *